United States Patent [19]

Johnson et al.

[11] Patent Number: 4,540,178

[45] Date of Patent: Sep. 10, 1985

[54] GOLF IRON AND METHOD OF CONSTRUCTION

[76] Inventors: Louis W. Johnson; Bruce G. Johnson, both of 2435 Prairie Rd., Eugene, Oreg. 97402

[21] Appl. No.: 527,826

[22] Filed: Aug. 30, 1983

[51] Int. Cl.[3] ..... A63B 53/02

[52] U.S. Cl. ..... 273/169; 273/167 F; 273/167 G; 228/101

[58] Field of Search ..... 273/171, 169, 170, 167 R, 273/167 F, 167 G, 167 K, 173, 79, 80.1–80.7, 168, 77 A; 228/101

[56] References Cited

U.S. PATENT DOCUMENTS

| | | | |
|---|---|---|---|
| 670,522 | 3/1901 | Thompson | 273/79 |
| 1,993,928 | 3/1935 | Glover | 273/79 |
| 3,970,236 | 7/1976 | Rogers | 228/196 |
| 3,999,765 | 12/1976 | Bishop | 273/171 X |
| 4,027,885 | 6/1977 | Rogers | 273/169 |

FOREIGN PATENT DOCUMENTS

| | | |
|---|---|---|
| 591595 | 8/1947 | United Kingdom . |
| 854746 | 11/1960 | United Kingdom . |
| 1363000 | 8/1974 | United Kingdom . |
| 1387955 | 3/1975 | United Kingdom . |
| 1534471 | 12/1978 | United Kingdom . |

*Primary Examiner*—William H. Grieb

*Attorney, Agent, or Firm*—Eugene M. Eckelman

[57] ABSTRACT

A hosel is formed with an upwardly opening socket for receiving a shaft that has a projecting flange with an outer edge. A ball striking plate is manufactured in separate form from the hosel and is secured to the flange in desired positions of loft and other relationships. One or more weights are arranged to be secured to the rear side of the ball striking plate for providing a desired club head weight and center of gravity. A method of the invention includes the steps of forming a hosel and the ball striking plate as separate elements and then shaping and positioning the flange for securing the ball striking plate at the desired angle and position.

9 Claims, 7 Drawing Figures

GOLF IRON AND METHOD OF CONSTRUCTION

BACKGROUND OF THE INVENTION

This invention relates to new and useful improvements in golf irons and to a method of their construction.

It is well known that golfers, in order to achieve their maximum ability in the use of golf irons, require irons of a selected weight. It is also well known that the force in striking a golf ball is computed by the formula of mass multiplied by the square of the velocity of the club head. Overall, a small person will require a lighter club than a larger person to achieve maximum force at the ball or similarly, women in general require a lighter club. In order to satisfy all types of golfers, it is apparent that many different weight golf clubs would have to be required.

The primary weight of the golf iron is in the head. Since these heads are generally either forged or investment cast and since forging dies and investment castings are very expensive, a minimum number of club weights are made available to the public.

The clubs are presently classified according to swing weight which comprises an assumed method of calibration based on a so-called balance point between the grip of the club and the head. In order to reduce the swing weight under this system and to provide a minimum number of forging dies and castings, it is customary to insert weight means in the grip. This of course provides an unsatisfactory condition since while it purports to reduce the swing weight, it actually increases the overall weight of the club without a true reduction of swing weight or swing inertia. The system now in use thus works in reverse because when it is desired to decrease the swing weight, it is also usually desired to decrease rather than increase the overall weight of the club, and vice versa.

SUMMARY OF THE INVENTION

According to the present invention and forming a primary objective thereof, a golf iron is provided which is simplified in its construction and inexpensive to fabricate in many different configurations and weights without the necessity of having a whole multitude of expensive forging dies or castings available to suit the many club weights.

A more particular object is to provide a golf iron that has a structure capable of satisfying a golfer's ability to obtain maximum force in striking the ball, namely, it contains a head structure that is capable of having its weight readily varied and also in such structure the club is capable of use with a balancing system that reduces in value upon the reduction of overall weight of the club, and, conversely, that increases in value upon increasing the overall weight of the club.

Another object is to provide a golf club that can readily be constructed either as a right-hand or left-hand club.

Still another object is to provide an improved method of fabricating a golf iron.

In carrying out these objectives, a hosel has a construction which includes an upwardly opening socket for receiving a shaft and also a laterally projecting flange to which a separately constructed ball striking plate is arranged to be secured during manufacture. A single die forging or casting of a hosel is employed and by suitable subsequent shaping of its flange and the position of securement of the ball striking plate thereto, club heads can be formed with the desired shape of head and desired loft. The ball striking plate includes means for securing one or more weights to the rear side thereof to provide a predetermined weight of the club head. Such structure permits use of the club with a swing inertial balancing system that is consistent with a golfer's ability, namely, the system of measurement reduces in value upon the reduction of the overall weight of the club and vice versa, as will be more apparent hereinafter.

DETAILED DESCRIPTION OF A PREFERRED EMBODIMENT

Figure 1:
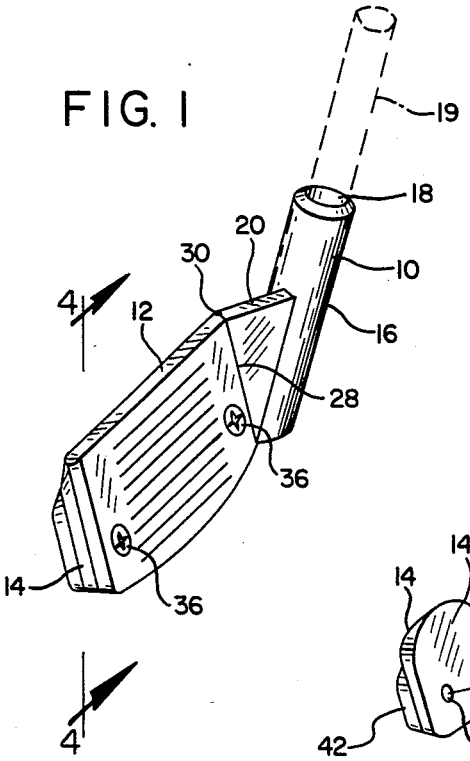
FIG. 1 is a perspective view of a golf iron embodying features of the instant invention.
Figure 2:
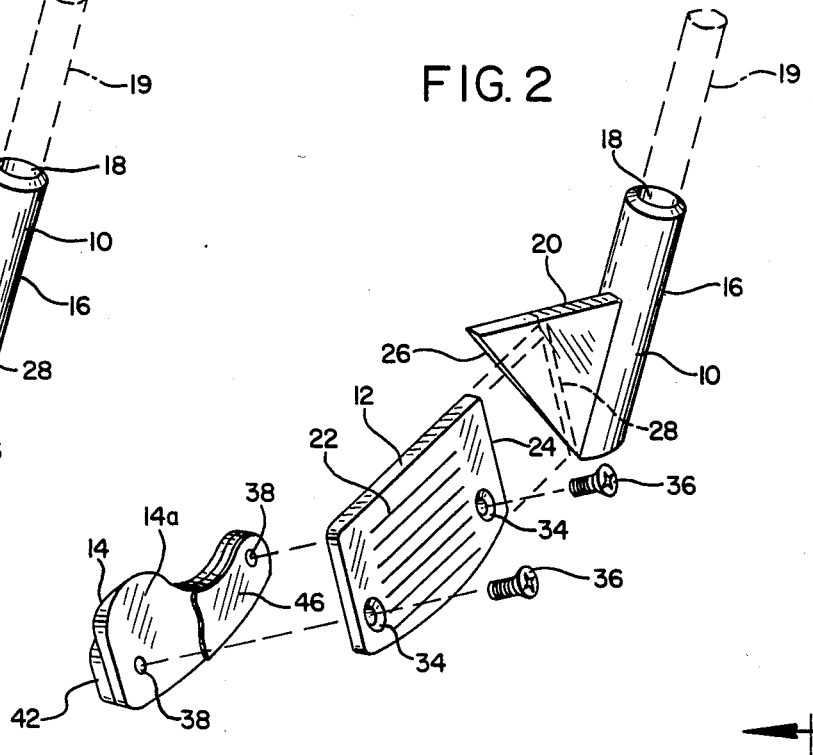
FIG. 2 is an exploded perspective view of golf club parts forming the invention in a step of fabricating the club.
Figure 3:
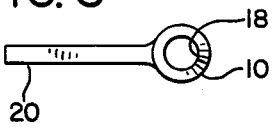
FIG. 3 is a top plan view of the hosel portion of the club.

With particular reference to the drawings, and first to FIGS. 1 and 2, the invention comprises basically three parts, namely, a hosel 10, a ball striking plate base member or 12, and weight means 14. The hosel 10 is constructed independently from the other two parts and a concept of the invention is to provide a single casting or die forging for the hosel 10 and to provide a novel secured connection thereof with the ball striking plate such that substantially any form, loft, and weight of club can be formed with the common hosel. For this purpose, the hosel comprises an upright body portion 16 having a top opening socket 18 for secured connection to a shaft 19 of conventional construction. Hosel 10 has a laterally projecting flange 20 which in a triangular shape is capable of forming a support for the ball striking plate 12 in various integrated positions of such plate, as will be more apparent hereinafter.

Ball striking plate 12 is preferably made from steel plate or equivalent material which can be readily cut or otherwise formed, such as by numerically controlled flame cutting machines, to the contour desired, such as a medium type profile, a low profile, a rectangular profile, a high toe profile tapering to a narrower heel, etc. The usual face grooves 22 are suitably cut therein.

Figure 4:
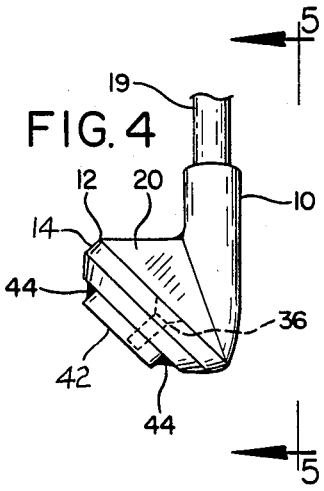
FIG. 4 is an edge view of the club head, taken on the line 4—4 of FIG. 1, the club head of FIG. 4 having a greater loft than the club shown in FIG. 1.
Figure 6:
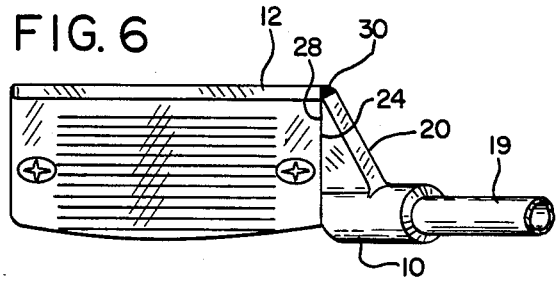
FIG. 6 is a plan view of the same club, taken on the line 6—6 of FIG. 5.
Figure 7:
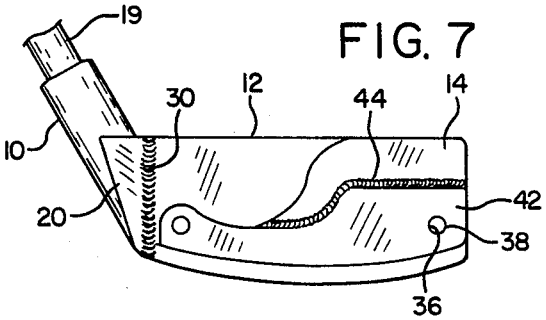
FIG. 7 is a rear elevational view of the club.

Regardless of the shape of the ball striking plate 12, it of necessity has a straight securing edge 24 arranged for integration, as by welding, to the flange 20 of the hosel 10. With the structure of the two parts 10 and 12 as described, a club head of any shape or loft can readily be fabricated. That is, by shaping the outer or angled edge of the flange and providing the desired lateral angle between the flange 20 and the ball striking plate 12, a club head of any suitable loft can be provided. More particularly, the numeral 26 represents the outer edge of the flange 20 as originally formed. In constructing an iron, the edge 26 is cut back to an edge 28 which positions the plate 12 at the desired lateral angle and loft and the plate 12 then secured, as by welding, with its edge 24 engageable with edge 28. Any rear opening between the abutting edges 24 and 28 resulting from an angular disposition of the plate 12 and the flange 20 is filled with weld material 30, FIG. 1. FIGS. 1 and 2 show a club construction with a small loft, such as a 2 or 3 iron. With reference to FIGS. 4 and 6, the ball striking plate 12, however, can be combined with a suitably cut edge 28 of the flange 20 to provide a greater loft face, such as a nine iron or wedge. For this purpose, and as best seen in FIG. 6, the flange 20 angles rearwardly so that the plate 12 can be laid down in a greater loft position and with the cut edge 28 made for abutment with edge 24 to provide integral support for the plate 12 in the properly aligned position with the shaft. Here again, any rear opening at the abutting edges 24 and 28 is filled with weld material 30.

Upon securement of the plate 12 to the hosel as noted above, suitable finishing of the club can be accomplished. That is, joining edges can be rounded or filled in to provide a finished one-piece appearance.

Figure 5:
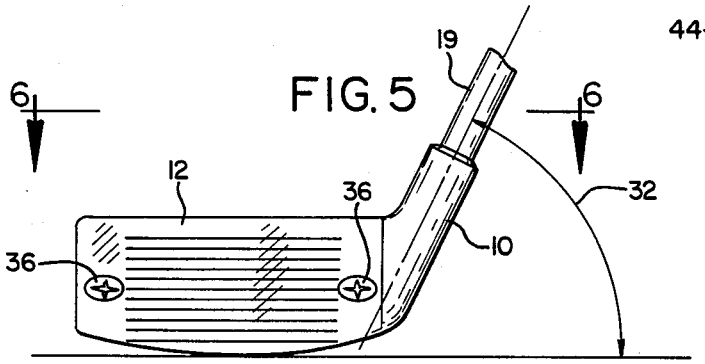
FIG. 5 is a face view of the club of FIG. 4, this view being taken on the line 5—5 of FIG. 4.

In addition to providing the necessary angle and loft in the construction of the parts 10 and 12, the plate 12 is properly secured to accomplish the desired lie angle 32, FIG. 5, between the shaft and the plate 12.

The plate-like construction of the member 12 facilitates the mounting of the weights 14 on the rear side thereof. For this purpose, plate 12 has one or more apertures 34 arranged to receive screws 36 having threaded engagement in tapped bores 38 in the weight means 14. By suitable selection of the weight means 14, club heads of predetermined weights can be provided. The weight means 14 may be contoured to any desired shape for the purpose of providing a pleasing appearance and also for locating the center of gravity of the club head in a desired selected location. Weight 14 as illustrated herein has an enlarged portion 14*a* toward the toe of the club to provide an outward center of gravity, but any selected shape can be provided for best results. An auxiliary weight 42 may be secured to the rear side of weight 14 if desired or necessary and can be welded in place, as shown by the numeral 44, or can be secured in position by the screws 36. Thus, by employing the weight 14 and the weight 42 in combination therewith, any suitable club head weight can be provided. Furthermore, thin shims 46, FIG. 2, of selected weight can be inserted between the weight 14 and the plate 12 to provide a fine value of club head weight. Shims 46 similarly have apertures 38 for receiving the screws 36. Upon building the club to the desired weight and center of gravity, the screws 36 may be replaced by rivets if desired or by other permanent means. The rear portions of the weights are suitably contoured to provide an attractive appearance.

The club is readily constructed either as a right-hand club as shown in the drawings or as a left-hand club. In a left-hand club, the grooves 22 are made on the opposite side of the plate 12 from that shown. The weights 14, 42 are installed on the rear side for the left-hand clubs in the same manner as that described in connection with the right-hand clubs.

According to the invention, a golf club structure is provided which is inexpensive to manufacture and in its manufacture can be built precisely to the weight desired by the golfer. By providing the weight or change of weight in the head of the club, such club can be used with a balancing system that is logical in its application, namely, if a golfer desires a reduction in the value of the balance of the club, the overall weight of the club also is reduced, and vice versa. With the present club, a golfer can be fitted to achieve maximum ability in applying force in striking the ball by finding the relationship of mass and velocity best suited for the golfer's capabilities. Only one forging or casting is required for the hosel, thereby eliminating the need for an expensive array of forgings and castings for many different hosel structures. Suitable cutting equipment and patterns can be provided for fast manufacture of the plates 12, and welding fixtures are readily available to properly secure the plate 12 to the hosel flange. The manner in which the present club is fabricated also makes it easy to produce a multitude of club shapes, designs, etc. with only the one hosel.

It is to be understood that the form of our invention herein shown and described is to be taken as a preferred example of the same and that various changes in the shape, size and arrangement of parts may be resorted to without departing from the spirit of our invention, or the scope of the subjoined claims.

Having thus described our invention, we claim:

1. A golf club iron comprising a head portion, said head portion including a hosel having means arranged to connect it to a shaft, said head portion also including a body member formed independently of said hosel, said body member having top and bottom edges and first and second end edges, said body member also having a front ball striking face and a rear face, and weld means engageable between said hosel at said first end edge of said body member securing said body member to said hosel in a desired permanently positioned loft and lie, said top and bottom edges of said body member and said second end edge thereof comprising perimeter edges of said head portion.

2. The golf club iron of claim 1 wherein said body member is formed from plate material whereby to have flat front and rear faces, and at least one independently formed, preselected weight secured permanently to said rear face.

3. The golf club iron of claim 1 wherein said body member is formed from plate material whereby to have flat front and rear faces, and independently formed, preselected weight means secured permanently to said rear face, said weight means including a main weight and a secondary weight, said secondary weight being of lesser selected value than said main weight and being used to provide a fine value of club head weight, said secondary weight comprising a shim-like insert disposed between said main weight and the rear face of said body member.

4. The method of constructing a golf club iron having a head portion for striking a golf ball, said method comprising the steps of forming a hosel as a part of said head portion with means for receiving a shaft, forming a body member as a part of said head portion but formed independently of said hosel, said body member being formed with top and bottom edges and first and second end edges, said body member also being formed with a ball striking face and a rear face, and welding said body member at its said first end edge to said hosel in a desired permanently positioned loft and lie with said top and bottom edges and said second end edge comprising perimeter edges of said head portion.

5. The method of claim 4 wherein said body member in its formation has flat front and rear faces, and including the step of securing independently formed, preselected weight means permanently to said flat rear face.

6. The method of claim 4 wherein said hosel is formed integrally with a laterally projecting flange having an outer free edge, and including the step of shaping said outer free edge of said flange and positioning said body member relative to said flange to provide securement of said first end edge of said body member to said outer free edge of said flange at a selected angle to accomplish a desired loft and lie of said ball striking head.

7. The method of claim 6 wherein said flange when formed with said hosel is of an enlarged size to accommodate shaping of various club heads.

8. The method of constructing a golf club comprising the steps of forming a hosel with means for receiving a shaft, forming a ball striking head independently of said hosel, said ball striking head being formed with opposite end portions and said hosel being formed with a laterally projecting flange having an outer free edge, and shaping said outer free edge of said flange and positioning said striking head relative to said flange while securing said end edge to said free edge of said flange at a selected angle to accomplish a desired loft and lie of said ball striking head.

9. The method of claim 8 wherein said flange when formed with said hosel is of an enlarged size to accommodate shaping of various club heads.

* * * * *